United States Patent [19]

Keith et al.

[11] 3,991,672

[45] Nov. 16, 1976

[54] LINE PRINTER FOR PRINTING INFORMATION ON TICKETS

[75] Inventors: Stephen G. Keith, Derry, N.H.; Charles J. Casey; Edward F. Burke, Jr., both of Reading, Mass.; John L. Apostoles, Manchester, N.H.

[73] Assignee: MFE Corporation, Salem, N.H.

[22] Filed: Apr. 25, 1975

[21] Appl. No.: 571,857

[52] U.S. Cl. ..... 101/99; 101/233; 271/273

[51] Int. Cl.[2] ..... B41J 9/38

[58] Field of Search ..... 101/95, 96, 99, 110, 101/232, 233, 234, 239, 242; 271/265, 273, 274; 197/127; 194/19

[56] References Cited

UNITED STATES PATENTS

| | | | |
|---|---|---|---|
| 1,955,814 | 4/1934 | Kranz | 101/233 |
| 2,594,705 | 4/1952 | Aberle | 101/233 |
| 3,241,665 | 3/1966 | Erk | 271/273 X |
| 3,438,323 | 4/1969 | Smitzer et al. | 101/233 |
| 3,576,163 | 4/1971 | Lawson | 101/233 |
| 3,821,519 | 6/1974 | Pietenpol | 271/273 X |
| 3,863,913 | 2/1975 | Hirafuji | 271/265 |

*Primary Examiner*—Edward M. Coven
*Attorney, Agent, or Firm*—Cesari and McKenna

[57] ABSTRACT

A line printer for printing successive lines of information on a ticket. As the ticket is guided toward ticket printing and advancing mechanisms, a first ticket sensor energizes a latch circuit and shifts the ticket advancing mechanism from a normally closed condition to an open condition. The ticket then moves freely into the printer to a predetermined position defined by a stop. A second ticket sensor at the stop is then actuated to close the ticket advancing mechanism and enable ticket advancement.

11 Claims, 8 Drawing Figures

17
10
31
41
18
12
11
33
38
40
32
35
36
A
B
C
SOLENOID DRIVER
57
52
50
(VI)
53
42
D
Q
C
R
51
54
75
76
16
BUSY
CONTROL CIRCUIT
60
73
72
56
74
71
43
DATA SOURCE
15
55
64
65
66
70
63
67
TICKET LATCH CONTROL CIRCUIT 34

LINE PRINTER FOR PRINTING INFORMATION ON TICKETS

BACKGROUND OF THE INVENTION

This invention generally relates to line printers, and more specifically to line printers which are useful for printing successive lines of information on tickets.

Various instruments and other data sources produce information for display as alphabetic or alphanumeric characters by output devices, such as line printers. This invention is particularly applicable to a class of line printers comprising a printing drum in the form of a set of type wheels that rotate in unison on a common shaft intermittently between successive positions. A printing hammer is actuated whenever a comparison circuit indicates that a symbol or character on the type wheel then facing the material to be printed corresponds to the character actually to be printed by that wheel.

These line printers generally print on a roll of paper stored inside a printer housing. When a roll runs out, paper from a new roll is fed into a paper advancing mechanism that feeds the paper past the type wheels. All motion of the paper through the printer is unidirectional, and the paper advancing mechanism is constructed so the paper can be driven or pulled in that same direction with relative ease. Any attempted movement in a reverse direction is met with significant resistance.

These printers are not readily adapted for printing tickets or other short materials. It is desirable in printing a ticket to insert and retrieve the ticket from one slot in the printer. In such a printer the ticket would be fully inserted into the printer and subsequent printing operations would advance the ticket out of the printer or, conversely, the ticket would be inserted to a first position, printed as it was advanced into the printer and then either released for withdrawal or ejected.

Therefore, it is a primary object of this invention to provide a line printer which is adapted for printing on tickets or other material of a short length.

Another object of this invention is to provide a control circuit for a ticket line printer.

Still another object of this invention is to provide a line printer that is simple to design, reliable, of small size and relatively inexpensive to manufacture.

SUMMARY

In accordance with this invention, a ticket, or other short material, is guided through a slot in a panel toward a printing and ticket advancing mechanism. A first sensor responds as the ticket moves past at a first position and opens the ticket advancing mechanism so that the ticket can be moved therethrough to a stop. At the stop, a second sensor then transmits a condition signal which simultaneously enables the printer to begin operating and closes the ticket advancing mechanism on the ticket so that it can advance the ticket as successive lines of symbols are printed on the ticket.

This invention is pointed out with particularity in the appended claims. A more thorough understanding of the objects and advantages of this invention may be attained by referring to the following detailed description taken in conjunction with the accompanying drawings.

DESCRIPTION OF AN ILLUSTRATIVE EMBODIMENT

Figure 1:
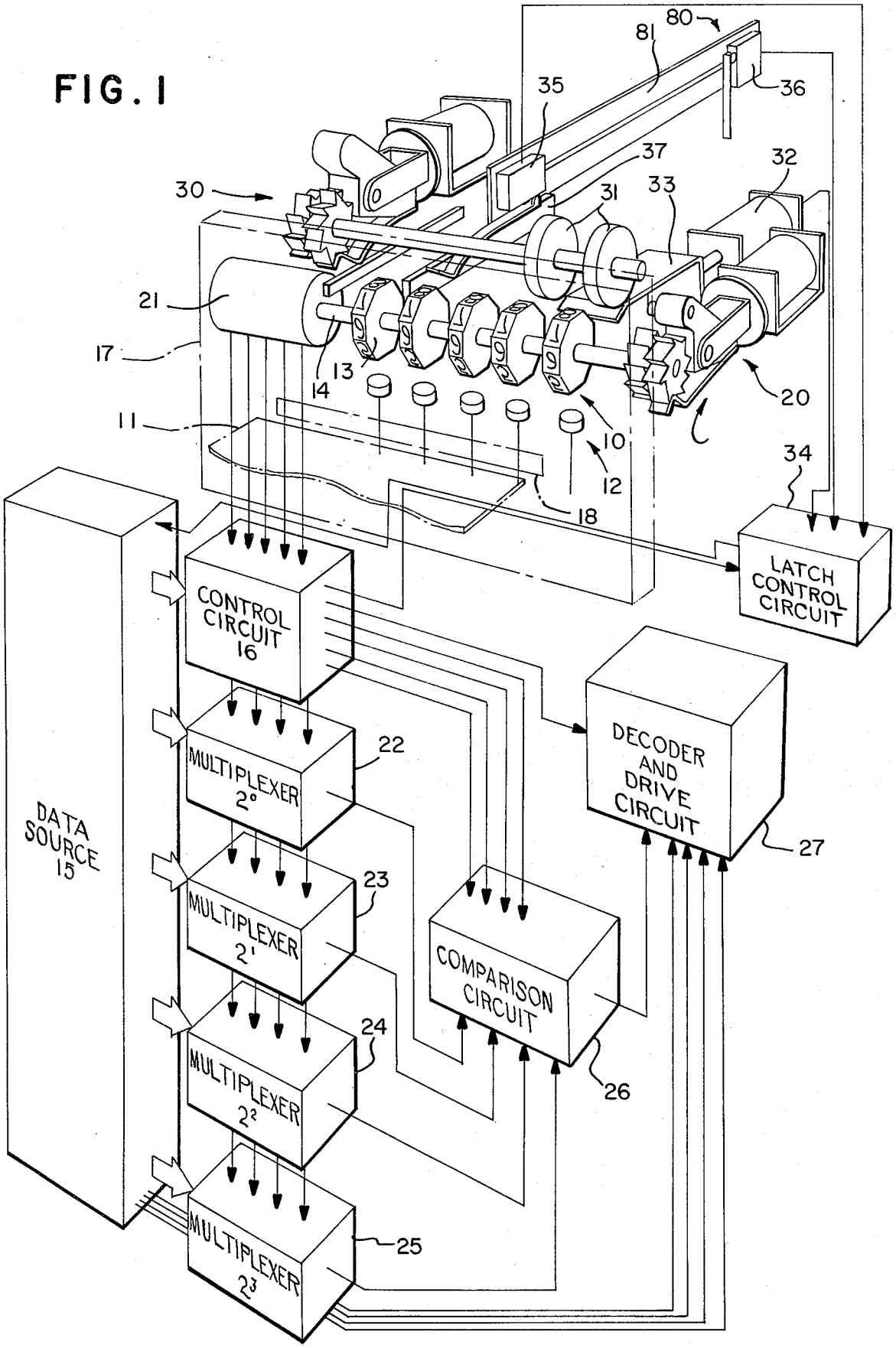
FIG. 1 is a simplified perspective view, in partly schematic form, of a line printer embodying this invention.

Referring now to FIG. 1, a line printer embodying this invention includes a drum 10 carrying on its surface type that prints characters on a paper ticket 11 in response to the striking action of hammers 12. The drum comprises a set of type wheels 13 mounted on a shaft 14, with the angular positions of the wheels 13 being fixed with respect to the shaft by conventional means. The characters to be printed are selected by a data source 15 which provides character selecting signals and other control signals to a control circuit 16. The drum 10, hammers 12 and other parts of the printer generally are mounted in a cabinet which includes a front panel 17 with a ticket slot 18 which serves as an entrance and exit for the ticket 11.

The drum 10 is rotated in a stepwise fashion by an indexing mechanism generally indicated at 20. A position sensor 21 senses the position of the drum 10 after each step and transmits a set of signals for each angular position of the drum 10. Each time the indexing mechanism 20 advances the drum 10 to a new position, the position sensor 21 transmits a new set of signals which uniquely identifies the particular angular position. As the type wheels 13 are fixed to the shaft 14, these signals also specify the characters which are then positioned to be printed on the ticket 11 if struck by the hammers 12.

The data source 15 provides a binary-coded-decimal (BCD) or other equivalent signal pattern for each type wheel. Each type wheel prints its characters in a column, so the signals from the data source collectively represent all the characters to be printed on one line. They are all fed in parallel to an array of multiplexers 22, 23, 24 and 25. Each multiplexer corresponds to a specific bit position and receives a corresponding signal for each BCD pattern transmitted by the data source 15. That is, the multiplexer 22 receives the least significant, or $2^0$, bits for each column while the multiplexer 25 receives the most significant, or $2^3$, bits for each column.

In response to a print command from the data source 15, the control circuit 16 produces, at each position of the printing drum 10, a series of control signals in sequence. A first series of control signals constitute column selection signals which, in sequence, select each type wheel and which select those data signals at the inputs of the multiplexers 22 through 25 which correspond to the designated column. When a comparison circuit 26 receives a pattern of signals for a selected column which is comparable to the pattern of data signals from the position sensor, it enables a printing operation to occur. When all the columns have been designated, the control circuit 16 produces a second series of signals which provide various timing functions during which the drum 10 is advanced to its next position. After the entire sequence of control signals terminates, the control circuit 16 repeats the sequence for the next position of the drum.

For example, consider that the data source 15 is transmitting the BCD number "0100" to be printed in the third printing column. Regardless of the position of the drum 10, the output of the multiplexers 25 through 22 will be, respectively, "0—1—0—0" each time the control signals from the control circuit 16 identify column 3.

When a comparison circuit 26 enables a printing operation, a decoder and drive circuit 27 responds to the control signals to energize one of the hammers 12 which is associated with the identified column to print the character on the ticket. Thus, each line of characters is printed by stepping the drum 10 through all its positions. At each drum position, all the incoming data signals from the data source 15 are decoded in sequence to determine whether, for that drum position, the character for each column should be printed.

Once all the drum positions have been scanned, the control circuit 16 transmits a ticket advance signal. Another indexing mechanism 30 then rotates drive wheels 31 through a fixed angular step thereby advancing the ticket to the next position. Then the printer can print the next line.

As previously indicated, the ticket moves in opposite directions. In accordance with this invention, a solenoid 32 in FIG. 1 controls the position of a pressure plate 33 in response to signals from a latch control circuit 34. The latch control circuit 34 receives signals from a first position sensor 35 and a second position sensor 36 which are disposed adjacent a guide assembly 37. The wheels 31 and pressure plate 33 constitute a ticket advancing mechanism which has two possible conditions or states; namely, a closed condition and an open condition. In the closed condition, the plate 33 is biased against the drive wheels 31. In the open condition, the plate 33 is withdrawn from the drive wheels 31 so that the ticket readily can pass between the drive wheels 31 and the plate 33.

Basically, as the ticket is inserted into the line printer through the slot 18 in the panel 17 along the guide assembly 37, the first position sensor 35 and latch control circuit 34 energize the solenoid 32. In the energized state, the solenoid 32 retracts the pressure plate 33 and establishes the open condition whereby the ticket 11 passes by the drive wheels 31 freely. When the ticket 11 is fully inserted, the second position sensor 36 and the latch control circuit 34 deenergizes the solenoid, and the pressure plate 33 is again biased against the drive wheels 31. This causes the ticket 11 operably to engage the drive wheels 31. Printing operations can occur when the drive wheels 31 and plate 33 are closed. The ticket latch control circuit 34 also transmits various feedback signals to assure that the data source 15 does not initiate a printing operation until the printer is latched.

Figure 2:
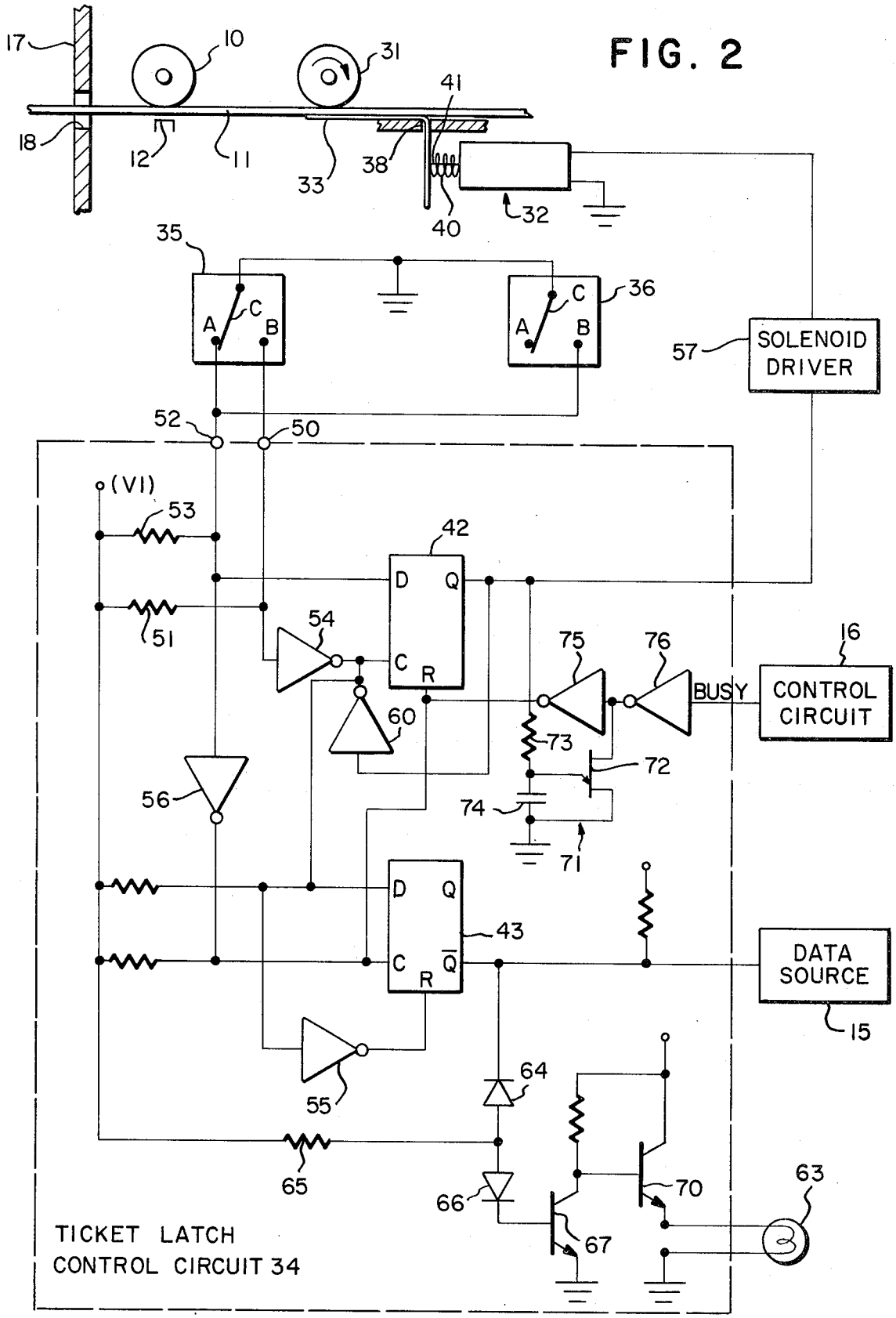
FIG. 2 is a schematic diagram of a ticket latch control circuit shown in FIG. 1.

FIG. 2 is a detailed logic diagram which depicts the operation of the ticket latch control circuit 34 shown in FIG. 1, together with the related printer elements. The plate 33 pivots on a support plate 38 normally to force the ticket 11 against the drive wheels 31 under bias provided by a return spring 40 on a solenoid armature 41. When the drive wheels 31 rotate clockwise, they drive the ticket 11 toward the printing means, i.e., the printing drum 10 and hammers 12. However, when the latch control circuit 34 energizes the solenoid 32, the armature 41 retracts and pivots the pressure plate 33 away from the drive wheels 31.

Switches 35 and 36, commonly micro-switches, have actuators disposed on opposite sides of the drive wheels 31 to thereby define a first, or entry, position and a second, or stop, position. Referring to FIGS. 1 and 2, a ticket is inserted through the panel 17 and passes between the printing drum 10 and hammers 12. As it then passes the entry position, it actuates the switch 35 before it reaches the drive wheels 31 and plate 33. When the ticket is fully inserted it activates the switch 36.

Still referring to FIG. 2, switch 35 has a normally closed contact 35A, a normally open contact 35B and a grounding switch arm 35C. Likewise, the switch 36 has a normally closed contact 36A, a normally open contact 36B and a grounding switch arm 36C. Switch 35, as a first position sensor, forms with a first bistable circuit constituted by a D-Type flip-flop 42, a first sensing circuit for actuating the solenoid 32 thereby to open the paper advancing mechanism. The switch 36, as a second position sensor, forms with a second bistable means in constituted by another D-type flip-flop 43, a second sensing circuit for causing the paper advance mechanism to close and for transmitting to the data source 15 a signal indicating that a printing operation can begin. Thus, flip-flops 42 and 43 constitute a sequence memory which reflects the condition of the ticket advancing mechanism and to a certain extent, the position of the ticket.

Figure 3:
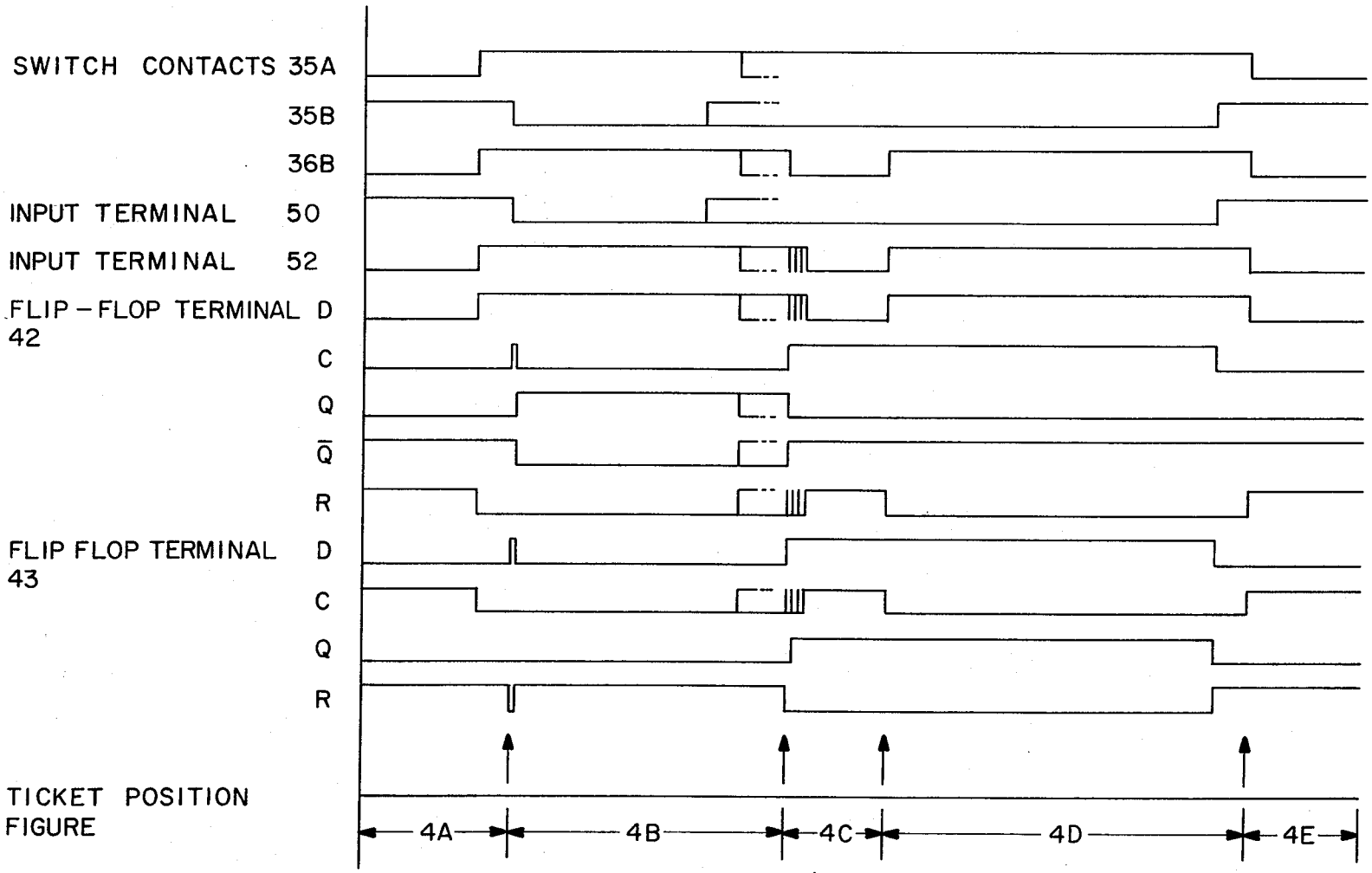
FIG. 3 is a timing diagram to facilitate an understanding of the circuit shown in FIG. 2 as a ticket moves between the various positions in the printer.
Figures 4A, 4B, 4C, 4D, 4E:
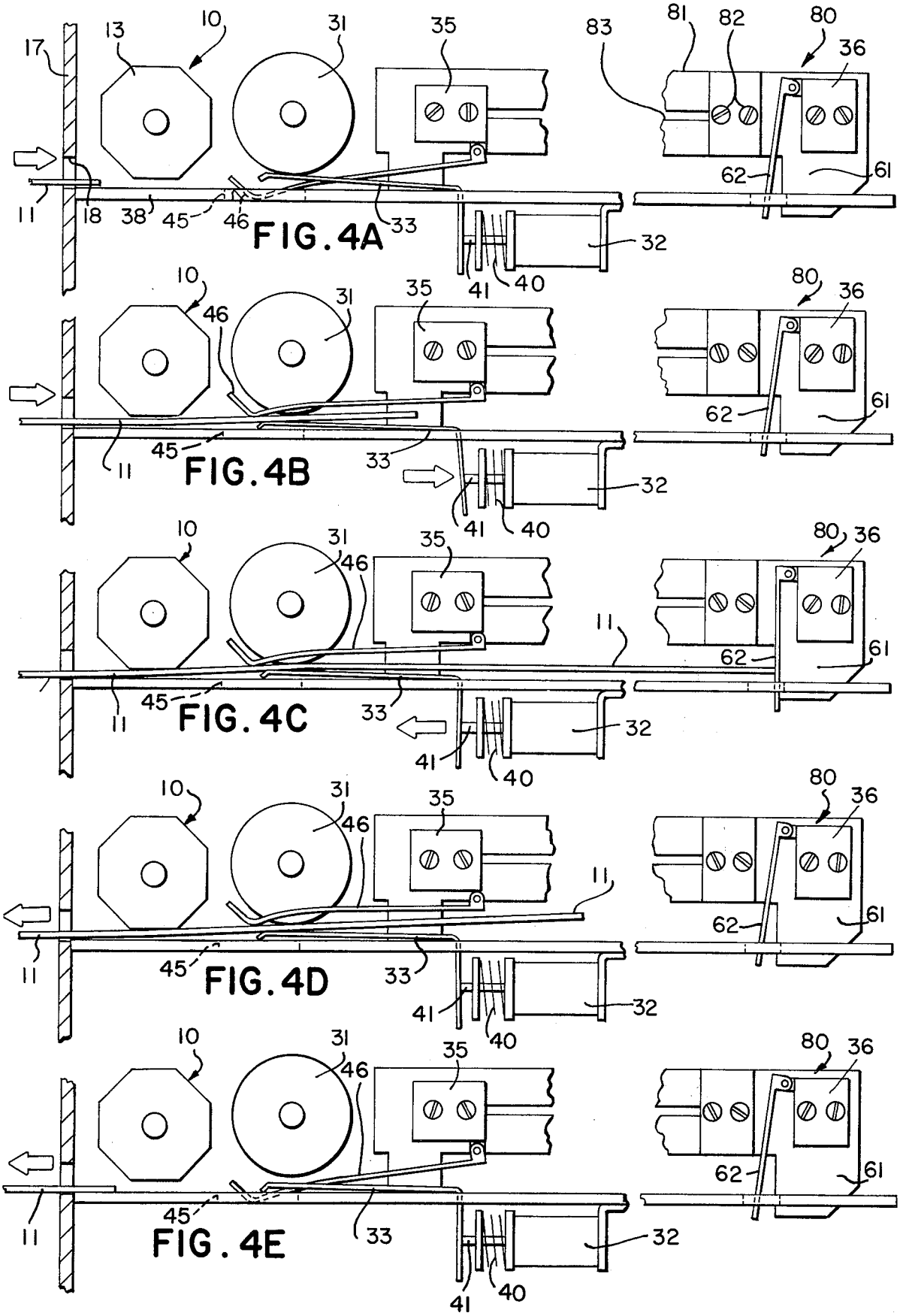
FIG. 4 comprises FIGS. 4A through 4E which are simplified sectional views of portions of the line printer shown in FIG. 1 to illustrate the relationship of the mechanism at the corresponding ticket positions shown in FIG. 3.

FIGS. 2, 3 and 4 depict the normal operation of the line printer of FIG. 1 wherein a ticket 11 is initially inserted through the slot 18 in panel 17. As shown in FIG. 4A, the ticket passes through the first position as shown in FIG. 4B to the stop in FIG. 4C. Then the ticket advancing mechanism advances the ticket to the left, as shown in FIG. 4D, until the ticket is ejected, as shown in FIG. 4E.

Referring to FIG. 4A, after the ticket 11 enters the slot 18, it engages the support plate 38 and, as shown in FIG. 1, the guide assembly 37, to be guided toward the printing and advancing mechanisms. The first position along the support plate 38 is defined by an aperture 45 between the printing drum 10 and drive wheels 31 by an actuator 46 from the switch 35. The actuator 46 has a bezeled portion so the ticket 11 raises the actuator 46 and closes the switch 35 as it passes the first position at the aperture 45.

Referring to FIGS. 2 and 3, switches 35 and 36 are in their normal positions, so a terminal 50 is held at a positive voltage by means of a resistor 51 which connects to a positive power supply $V_1$ while grounded contact 35A maintains an input terminal 52 at ground, the power supply voltage V1 appearing across a resistor 53. The use of these dropping resistors to shift the voltage on a conductor between the positive and ground states is well known in the art. Although other such dropping resistors are shown, they are not discussed further. With the input terminal 52 grounded, the D input to the flip-flop 42 is at ground. An inverter 54 connected to the input terminal 50 also grounds the C input of the flip-flop 42. Another inverter 55, connected to the output of the inverter 54, transmits an overriding resetting signal and resets the flip-flop 43. Likewise, an inverter 56, connected to the input terminal 52, biases the C input of the flip-flop 43 to a positive level and resets the flip-flop 42 with an overriding reset signal.

When the leading edge of the ticket 11, in FIG. 4B, passes the first position and raises the actuator 46, the switch 35 "breaks" contact 35A and then "makes" contact 35B. Although two distinct transitions result, namely, break and make signals at the juncture of ranges 4A and 4B, the total change-over occurs very rapidly. when the switch arm 35C "breaks" contact 35A, the input terminal 52 shifts to a positive level, and the inverter 56 removes the overriding resetting signal to the flip-flop 42 and shifts the clocking signal for the flip-flop 43 to ground. However, both the flip-flops 42 and 43 remain reset. When the switch arm 35C then "makes" with the contact 35B, the input terminal 50 shifts to a ground level and the output from the inverter 54 clocks the flip-flop 42 to a set condition. The positive signal from the Q output terminal of the flip-flop 42 activates a solenoid driver circuit 57 which energizes the solenoid 32. The pressure plate 33 retracts and opens the ticket advancing mechanism.

When the flip-flop 42 sets, an inverter 60 immediately drives the C input to the flip-flop 42 back to ground so the input signal to the C input is a short pulse. Other signal transitions which occur have no effect so they are not discussed. They are shown in FIG. 3, however.

Thus, the first sensing means comprising the switch 35 and the flip-flop 42 responds to the movement of ticket 11 past the first position defined by the aperture 45 along the guide assembly 37 and the support 38 for energizing the solenoid driver 57 and opening the ticket advancing mechanism to receive the ticket.

When the ticket reaches a rear stop 61, as shown by the sequence in FIGS. 4B and 4C, an actuator 62 on the switch 36 shifts the switch arm 36C to ground the contact 36B. As known, switch closure produces a bouncing action, so the input terminal 52 receives a series of negative-going pulses in rapid sequence as shown in FIG. 3 at the juncture of ticket positions 4B and 4C. The first negative-going pulse passes through the inverter 56 and resets the flip-flop 42, thereby disabling the solenoid driver 57 and de-energizing the solenoid 32. The spring 40 then biases the plate 33 against the ticket 11 so subsequent drive wheel rotation advances the ticket 11.

The inverter 60 allows the signal at the C-input of the flip-flop 42 and the D input of the flip-flop 43 to rise to a positive level. Thus, a subsequent negative-going pulse at input terminal 52 enables the inverter 56 to clock the flip-flop 43 to its set condition. When the flip-flop 43 sets, its output signal constitutes a condition signal which positively indicates that the ticket advancing mechanism is closed. The data source 15 uses this condition signal to enable printing operations.

The flip-flop 43, when set, energizes an indicator lamp 63 which may be mounted on the panel 17. Specifically, when the flip-flop 43 sets, the $\overline{Q}$ output terminal shifts to ground. A circuit including a diode 64 and resistor 65 conducts and lowers the potential at the anode terminal of another diode 66, thereby turning off a pnp transistor 67 and turning on a pnp transistor 70 to energize the lamp 63 in the emitter circuit.

As successive lines of data are printed, the ticket advances to the left as shown in FIG. 4C and 4D. When the first ticket advance occurs, the actuator 62 causes the switch arm 36C to return to contact 36A and the input terminal 52 shifts to a positive level and establishes an active printing condition which exists until the ticket clears the first position defined by the actuator 46 and the aperture 45. The positive signal at the input terminal 52 removes the overriding reset signal from the flip-flop 42 and also the positive input to the C input of the flip-flop 43. However, no other changes occur, so that the solenoid 32 remains de-energized and the flip-flop 43 continues to indicate that the ticket advancing mechanism is closed.

When the ticket 11 does pass the first position, i.e., the aperture 45, the switch 35 reverts to its normal position; and the signal at the input terminal 50 shifts to a positive level so the inverters 54 and 55 reset the flip-flop 43 and disable the condition signal. Immediately thereafter the signal at the input terminal 52 shifts to a ground level, but no changes occur. Then all the signals are at their initial levels.

The ticket latch control circuit 34 also takes into account various alternate operational sequences. For example, a person merely might partially insert the ticket 11 to a position such as shown in FIG. 4B. The flip-flop 42 is set and energizes both the solenoid 32 and a unijunction transistor timing circuit 71 comprising a unijunction transistor 72, a resistor 73 and capacitor 74 connected as a timing circuit. When the unijunction transistor timing circuit 71 completes an interval, the transistor 72 discharges. An inverter 75 applies an overriding resetting signal to the flip-flop 42 thereby de-energizing the solenoid driver 57. No further operations occur so the flip-flop 43 never indicates to the data source 15 that the ticket advancing mechanism is closed. As the plate 33 pivots on the support 38 to the right of drum 31 as shown in FIG. 4B, the ticket can thereafter be withdrawn even though the advancing mechanism is closed. However, it cannot be inserted further.

Alternately a person may partially insert the ticket, but withdraw it before the unijunction transistor timing circuit 71 resets the flip-flop 42. When the terminal 52 shifts to ground as the switch arm 35C "makes" with the input terminal 35A, the signal from the inverter 56 resets the flip-flop 42 and the other various signals revert to their initial levels.

Some line printers also may be adapted to advance the ticket rapidly without any printing operations under the control of a signal from the data source. Whenever this signal or other signals are received, the control circuit 16 in FIG. 2 transmits a BUSY signal. An inverter 76 and the tandem inverter 75 immediately reset the flip-flop 42 and de-energize the solenoid driver 57 and the solenoid 32, so the plate 33 shifts immediately to its closed position. However, there is no indication by the flip-flop 42 that the ticket advancing mechanism is closed.

Referring now to FIGS. 1 and 4A, the line printer can accommodate tickets of different lengths by a simple means. Specifically, the stop 61 is formed as part of a stop member 80 which slides on a bracket support 81 mounted to the support 37 (FIG. 1). A bolt and nut assembly 82 or like fastening means passes through the stop member 80 and a slot 83 in the bracket support 81 so that the stop member 61 and switch 36, which constitutes a sub-assembly with the stop member 80, can be positioned along the bracket support 81 to define an appropriate second ticket position.

Thus, in accordance with the several objects of this invention, there is disclosed a line printer which is useful in printing symbols or tickets or other media.

The ticket advancing mechanism can accommodate the movement of paper in opposite directions under the appropriate conditions and the ticket latch control circuit 34 coordinates the operation of the latching assembly and the other line printer operations. The use of the various sensors and bistable means at various positions provides a simple automatic control for shifting the advancing mechanism between opened and closed conditions. Furthermore the advancing mechanism and circuit simplify and further reduce line printer costs. For example, the timing circuit shown in FIG. 2 controls the limits the maximum energy which the solenoid 32 can receive. Thus, a less expensive solenoid can be chosen.

It will also be apparent that there may be many modifications from this specifically disclosed embodiment without departing from the spirit and scope of this invention. Specifically disclosed circuits may be implemented differently. For example, FIG. 2 uses a number of inverters to form OR gates. Conventional gating circuits might also be used to provide the various signal combinations. A specific indicator and timing circuits have been shown, but alternate circuits, known in the art, could be substituted. Further, this invention has been described with respect to a particular line printer. It will be apparent that it can be utilized with a wide variety of line printers. Therefore, it is the object of the appended claims to cover all such variations and modifications as come within the true spirit and scope of this invention.

What is claimed that is new and desired to be secured by Letters Patent of the United States is:

1. A line printer for printing symbols on material, said line printer comprising:

A. support means,

B. printing means on said support means for printing symbols on the material,

C. guide means on said support means for receiving one end of the material and guiding the material to said printing means, the material being guided past a first position to a second position along said guide means, D. material advancing means on said support means spaced between the first and second positions along said guide means for advancing the material past said printing means, said material advancing means including i. material drive means for advancing the material, and ii. material engaging means for causing, in a first state, the material operably to engage said material drive means and for enabling, in a second state, the material to pass freely by said drive means, E. first sensing means on said support means responsive to the passage of the material past the first position along said guide means for causing said material engaging means to shift to its second state thereby to condition said material advancing means to receive the material, F. second sensing means on said support means responsive to the arrival of the material at the second position along said guide means for transmitting a condition signal, said first sensing means responding to said second sensing means by causing said material engaging means to shift to its first state thereby to condition said material advancing means to advance the material.

2. A line printer as recited in claim 1 wherein a data source provides signals to said line printer, said line printer additionally comprising a control circuit for controlling the operation of said line printer in response to the signals from the data source and the condition signal.

3. A line printer as recited in claim 1 additionally comprising indicator means responsive to the condition signal for indicating that said advancing means is conditioned to advance the material.

4. A line printer as recited in claim 1 wherein the material is to be inserted and withdrawn from said line printer, said line printer additionally including means connected to said first sensing means for terminating the condition signal from said second sensing means when the material is withdrawn from said line printer past said first sensing means.

5. A line printer as recited in claim 1 wherein said first sensing means generates an energizing signal to shift said material engaging means to its second state, said line printer additionally including a timer for defining a time interval, said first sensing means activating said timer when it energizes said engaging means, said timer being connected to disable said first sensing means at the end of the time interval.

6. A line printer as recited in claim 1 wherein:

A. said material engaging means includes i. pressure means operable between an open position and a closed position biasing the material against said drive means, and ii. solenoid means normally operable to maintain said pressure means in a closed position, and B. said first sensing means includes i. a first position sensor for generating a first signal in response to the passage of the material past the first position, and ii. bistable circuit means with set and reset output terminals for generating signals that indicate whether said bistable circuit is in a corresponding set or reset state, said set output terminal being connected to said solenoid means, the first signal from said first position sensor setting said bistable circuit thereby to energize said solenoid means.

7. A line printer as recited in claim 6 wherein said bistable circuit means has a level resetting input terminal, said line printer additionally comprising a unijunction transistor timing circuit responsive to a signal at an input terminal connected to said bistable circuit set output terminal for transmitting, after a time interval, a pulse to said bistable circuit level resetting input terminal.

8. A line printer as recited in claim 7 wherein said second sensing means includes:

i. a second position sensor for transmitting a second signal when the material arrives at the second position, ii. second bistable means with set and reset states, the second signal setting said second bistable means when said first signal is active, and iii. means for coupling the second signal to said level resetting input terminal of said first bistable means.

9. A line printer as recited in claim 8 wherein said guide means includes stop means for limiting the insertion of the material to define the second position, said second sensor being located adjacent to said stop means for transmitting the second signal when the material abuts said stop means.

10. A line printer as recited in claim 9 wherein said stop means includes bracket support means affixed to said support means and a stop member slidably connected to said bracket support means thereby to provide an adjustable stop means, said second sensor being affixed to said stop member.

11. A line printer as recited in claim 9 wherein said first and second sensors comprise switches wtih actuators disposed to close said switches when the material is present at the first and second positions along said guide means.

* * * * *